US005580342A

United States Patent [19]

Johnson

[11] Patent Number: 5,580,342

[45] Date of Patent: Dec. 3, 1996

[54] SUPPORT DEVICE FOR SHOULDER ROTATION EXERCISES

[76] Inventor: Ronald B. Johnson, 7018 S. 41st Pl., Phoenix, Ariz. 85040

[21] Appl. No.: 440,219

[22] Filed: May 12, 1995

[51] Int. Cl.[6] ..... A63B 23/00; A63B 21/00

[52] U.S. Cl. ..... 482/105; 482/10

[58] Field of Search ..... 482/105, 106, 482/107, 108, 109, 10; D12/178; D21/198

[56] References Cited

U.S. PATENT DOCUMENTS

| | | | |
|---|---|---|---|
| D. 211,144 | 5/1968 | Pawsat | D12/178 |
| D. 290,485 | 6/1987 | Suponitsky | D21/198 |
| D. 320,636 | 10/1991 | Eckler | D21/198 |
| 3,049,130 | 8/1962 | Fuschetti | 482/10 |
| 4,789,154 | 12/1988 | Mattox | 482/10 |

*Primary Examiner*—Stephen R. Crow

[57] ABSTRACT

A support device for performing shoulder rotation exercises, of a shape such that it rests against and on top of the upper shoulders of a typical person and passes under and partially around both upper arms of the person. The shape is also such that it supports the upper arms of the person in a position somewhat below and forward of the shoulders of the person, and restricts the upper arms of the person from moving forward, backward, or downward, but allows the upper arms of the person to rotate. The shape is also such that it does not rest against or cause force to be transmitted to the neck of the person.

4 Claims, 5 Drawing Sheets

SUPPORT DEVICE FOR SHOULDER ROTATION EXERCISES

BACKGROUND—FIELD OF THE INVENTION

This invention relates to exercise devices, specifically to a device to assist the performance of shoulder rotation exercises.

BACKGROUND—DESCRIPTION OF PRIOR ART

The Infraspinatus, Teres Minor, Supraspinatus, and Subscapularis are four muscles of the human shoulder which are commonly and collectively referred to as the "rotator cuff". The muscles of the rotator cuff stabilize the shoulder during all shoulder motions. They do so by holding the head of the Humerus (or upper arm) tightly into the Glenold Fossa of the Scapula.

In addition to stabilizing the shoulder, the muscles of the rotator cuff also have the ability to rotate the upper arm along its axis. If this rotation is done against a resistive force, these muscles can be strengthened or conditioned. This rotation movement, however, is relatively difficult to perform, and generally requires some type of external constraint or support to hold the upper arm in the appropriate position and limit the upper arm's motion to axial rotation.

Several exercise devices currently exist that support the upper arm and allow the device's user to resistively strengthen the muscles of the rotator cuff. All of the current devices, however, have significant problems. One problem is that, while all of the current devices support the upper arm, most of the current devices do not control the position of the upper arm relative to the position of the torso. If the upper arm is not in an appropriate position with respect to the torso, the shoulder rotation exercise can be less effective, and can even cause impingement within the structure of the shoulder that can lead to injury. A second problem with the current devices is that many of the devices only allow one shoulder to be exercised at a time. Since most people perform exercises for both shoulders, it is desirable to be able to exercise both shoulders simultaneously. A third problem is that most of the current devices are not portable. A fourth problem is that most or all of the current devices are not simple or economical to manufacture.

Heretofore, no device existed that supported the upper arms for performing shoulder rotation exercises, that controlled the position of the upper arm relative to the position of the torso, that allowed both shoulders to be exercised simultaneously, that was easily portable, and that was simple and economical to manufacture.

OBJECTS AND ADVANTAGES

Accordingly, one object and advantage of my invention is to provide an improved support device for performing shoulder rotation exercises. Other objects and advantages are to provide such a device which controls the position of the upper arm relative to the position of the torso, that allows both shoulders to be exercised simultaneously, that is easily portable, and that is simple and economical to manufacture. Still further objects and advantages will become apparent from a consideration of the ensuing description and accompanying drawings.

Reference Numerals

10 main member
12 central member
14 outer member
16 typical person
18 hand-held weights

PREFERRED EMBODIMENT—DESCRIPTION

Figure 1:
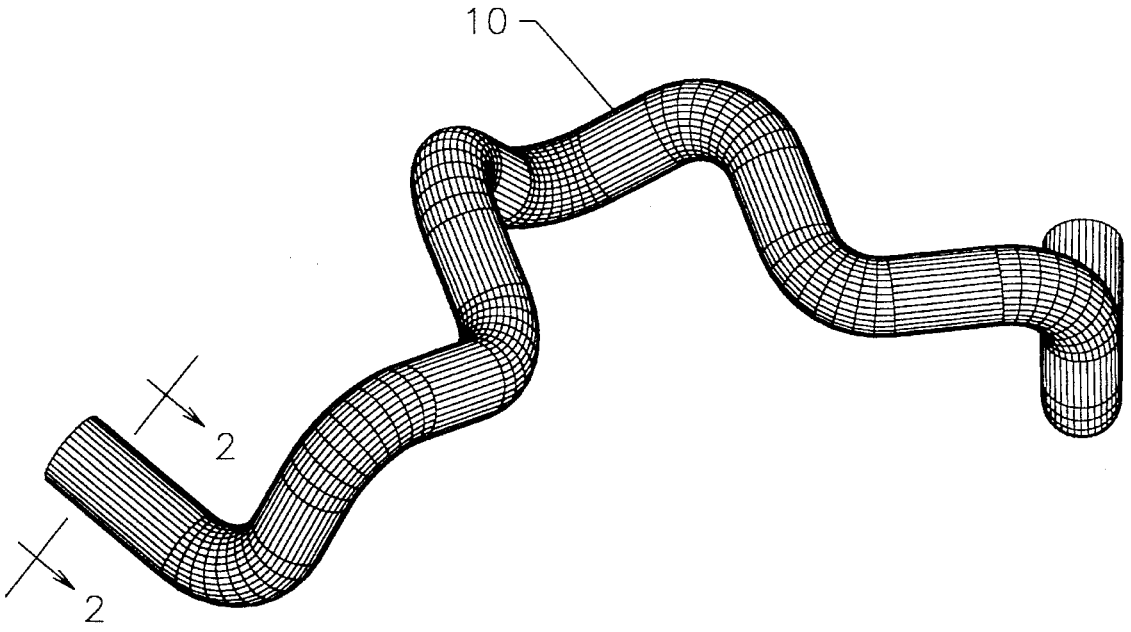
FIG. 1 is a perspective view of the present invention.

As shown in FIG. 1, the preferred embodiment of the present invention is comprised of a rigid and continuous main member 10, having a plurality of bends.

Figure 2:
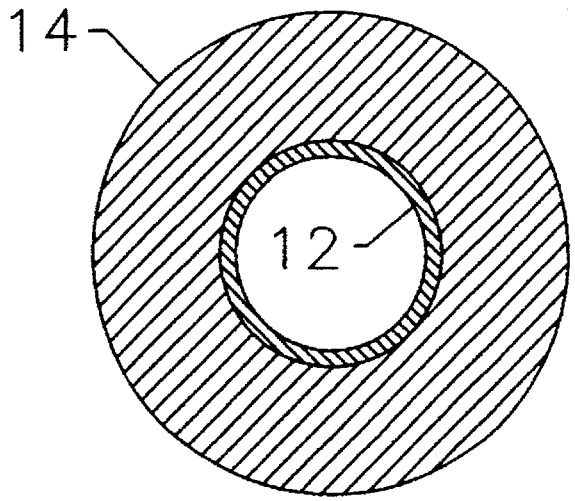
FIG. 2 is a view in detail of the portion indicated by section lines 2—2 in FIG. 1.

FIG. 2 shows a cross section of the portion of main member 10 indicated by section lines 2—2 in FIG. 1. In the preferred embodiment, the external shape of this cross section is round, and is of consistent size and shape at all points along the length of main member 10. FIG. 2 also shows that, in the preferred embodiment, main member 10 is comprised of a central member 12, preferably a steel tube, and an outer member 14, preferably made of compressible foam.

Figure 3:
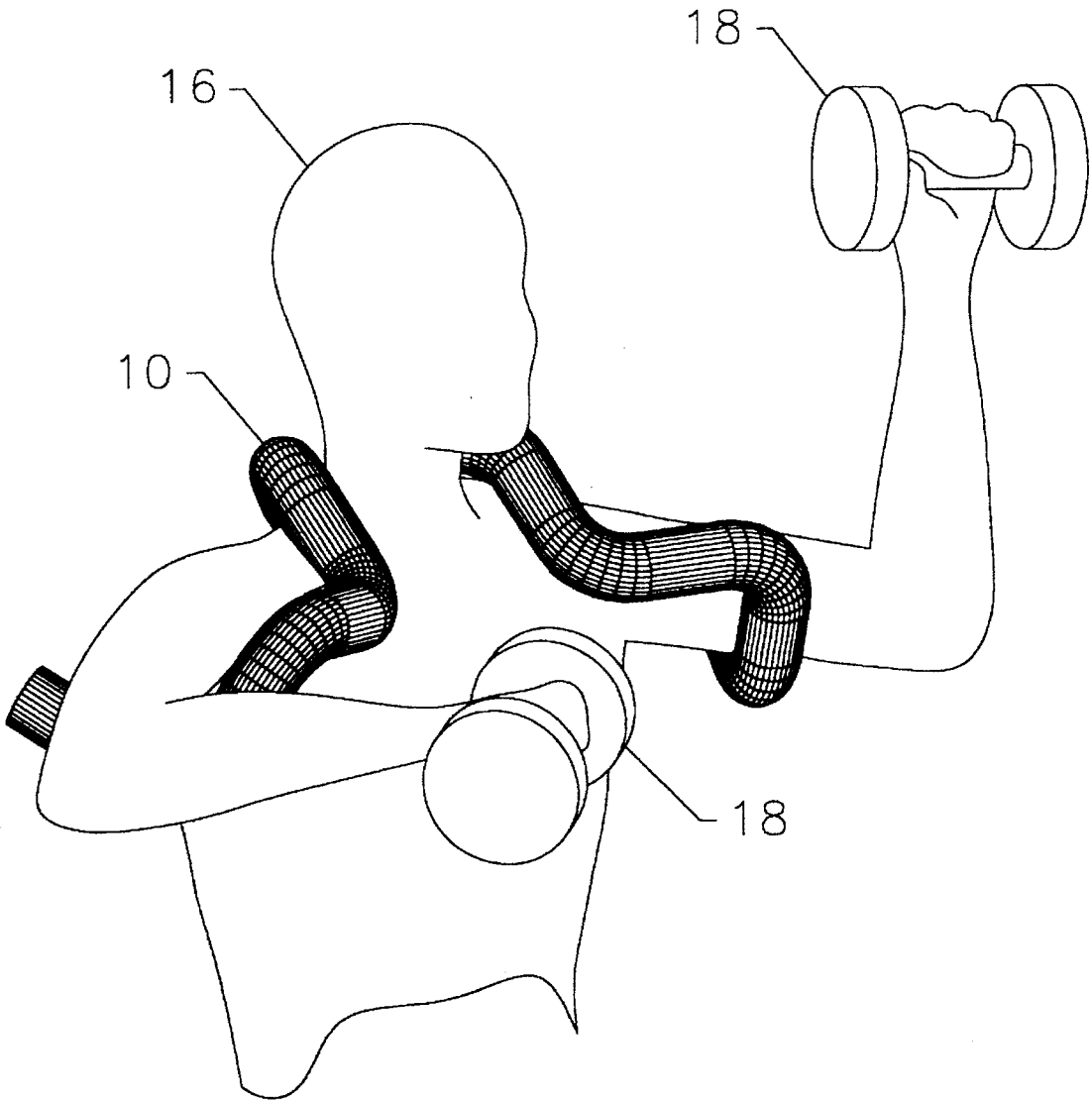
FIG. 3 is a perspective view of the present invention in normal use.
Figure 4:
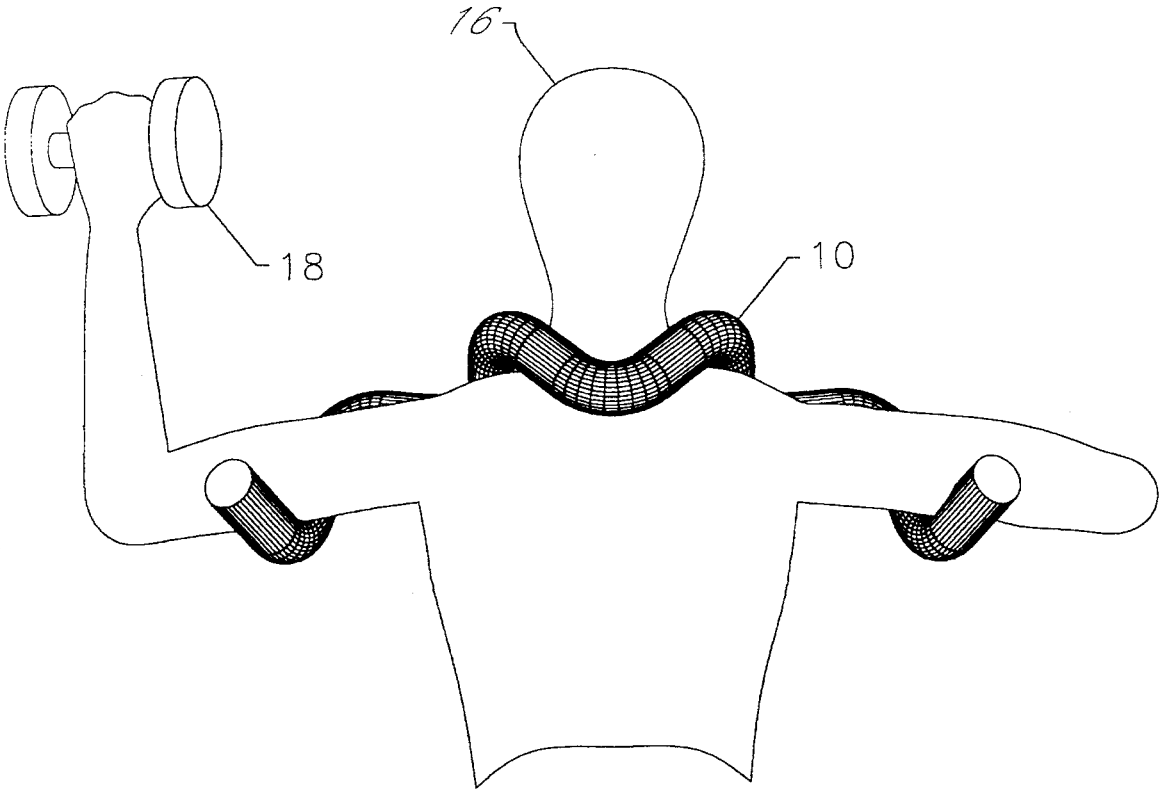
FIG. 4 is a rear view of the present invention in normal use.
Figure 5:
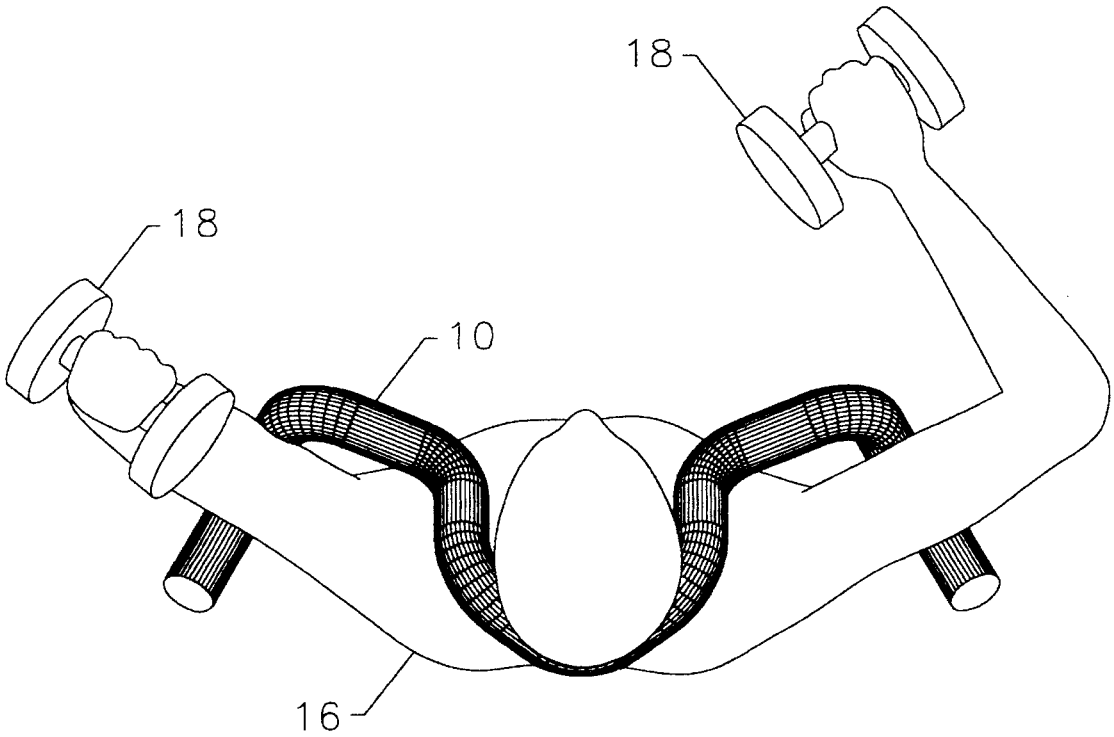
FIG. 5 is a top view of the present invention in normal use.

FIGS. 3, 4, and 5 show perspective, rear, and top views, respectively, of main member 10, as it is used by a typical person 16, and in conjunction with a pair of common hand-held weights 18. FIG. 3, 4, and 5 also show that the shape of main member 10 is such that it rests against and on top of the upper shoulders of person 16, and passes under and partially around both upper arms of person 16. The shape of main member 10 is also such that it, supports the upper arms of person 16 in a position somewhat below and forward of the shoulders of person 16, and restricts the upper arms of person 16 from moving forward, backward, or downward, but allows the upper arms of person 16 to rotate along their axes. The shape of main member 10 is also such that it does not rest against or cause force to be transmitted to the neck of person 16.

PREFERRED EMBODIMENT—OPERATION

The present invention is operated by first placing it on the body of person 16 in the orientation shown in FIGS. 3, 4, and 5. Main member 10 supports the upper arms of person 16 in a position somewhat below and forward of the shoulders of person 16, and restricts the upper arms of person 16 from moving forward, backward, or downward, but allows the upper arms of person 16 to rotate along their axes. Person 16 completes a shoulder rotation exercise by rotating one or both of his upper arms along their axes while holding hand-held weights 18, or any other equivalent form of exercise resistance.

In FIGS. 3, 4, and 5, person 16 is shown with his right arm in the starting position and his left arm in the ending position for one such form of shoulder rotation exercise. Other forms of shoulder rotation exercise that can be performed with the present invention include the same exercise described above and done with both arms simultaneously, the same exercise described above and done with a greater or lessor range of motion, the same exercise described above and done from a seated, bent forward, or partially or fully reclined body position, or any combination of the above permutations.

Conclusions, Ramifications, and Scope

Accordingly, it can be seen that, according to the invention, a device is provided that provides a support for performing shoulder rotation exercises, that controls the position of the upper arm relative to the position of the torso, that allows both shoulders to be exercised simultaneously, that is easily portable, and that is simple and economical to manufacture.

Although the description above contains many specificities, these should not be construed as limiting the scope of the invention but as merely providing illustrations of some of the presently preferred embodiments of this invention. Various other embodiments and ramifications are possible within it's scope. For example, the invention could have a different overall form or cross sectional shape, could have a cross sectional shape that varied from point to point along its length, could be constructed of different materials, or could be constructed from separable parts that were adjustably or non-adjustably fastened together.

Thus the scope of the invention should be determined by the appended claims and their legal equivalents, rather than by the examples given.

What is claimed is:

1. An exercise support device, said device having a shape that allows it to rest against and on top of the upper shoulders of a typical person while passing under and partially around both arms of said person, said device also having a shape that supports the upper arms of said person in a position somewhat below and forward of the shoulders of said person, said device also having a shape that restricts the upper arms of said person from moving forward, backward, or downward, but allows the upper arms of said person to rotate along their axes, said device also having a shape that does not rest against or cause force to be transmitted to the neck of said person; said device having the shape as substantially shown in FIGS. 3–5.

2. The exercise support device of claim 1, further comprising:

a rigid and continuous main member, said main member having a plurality of bends.

3. The exercise support device of claim 2, wherein:

said main member has nine bends.

4. An exercise support device for rotator cuff muscle exercises comprising an elongated continuous member, said member comprising:

a) a central yoke section having a central bend and a pair of proximal bends for permitting said central yoke section to pass around the trapezius muscles of the user;

b) medial sections extending from said yoke sections and having a plurality of bends for permitting said medial sections to pass forwardly over the shoulders and then distally and outwardly toward the arms of the user;

c) distal sections extending from said medial sections and having a bend for extending end sections of said member upwardly and rearwardly to provide a support bend for supporting the arms of the user in a position slightly below horizontal and angled forwardly;

said continuous main member being symmetrical about the central bend; whereby the upper body muscles are effectively isolated to exercise the rotator cuff muscles.

* * * * *